US005233397A

United States Patent [19]

Till

[11] Patent Number: 5,233,397

[45] Date of Patent: Aug. 3, 1993

[54] THERMAL TRANSFER APPARATUS

[75] Inventor: Henry R. Till, East Rochester, N.Y.

[73] Assignee: Xerox Corporation, Stamford, Conn.

[21] Appl. No.: 933,855

[22] Filed: Aug. 24, 1992

[51] Int. Cl.[5] ..... G03G 15/12; G03G 15/14

[52] U.S. Cl. ..... 355/279; 355/282; 355/285

[58] Field of Search ..... 355/271, 277, 279, 272, 355/278, 280, 281, 273, 282, 285, 295; 219/216

[56] References Cited

U.S. PATENT DOCUMENTS

| | | | |
|---|---|---|---|
| 2,990,278 | 6/1961 | Carlson | 355/281 X |
| 3,862,848 | 1/1975 | Marley | 355/275 X |
| 3,893,761 | 7/1975 | Buchan et al. | 355/272 |
| 3,957,367 | 5/1976 | Goel | 355/271 X |
| 4,095,886 | 6/1978 | Koeleman et al. | 219/216 X |
| 4,183,658 | 1/1980 | Winthaegen | 355/277 X |
| 4,341,455 | 7/1982 | Fedder | 355/274 |
| 4,453,820 | 6/1984 | Suzuki | 219/216 X |
| 4,541,709 | 9/1985 | Kampschreur | 355/277 |
| 4,682,880 | 7/1987 | Fujii et al. | 355/327 |
| 4,708,460 | 11/1987 | Langdon | 355/271 |
| 4,796,048 | 1/1989 | Bean | 355/277 |
| 4,992,833 | 2/1991 | Derimiggio | 355/271 X |

FOREIGN PATENT DOCUMENTS

| | | | |
|---|---|---|---|
| 0171114 | 2/1986 | European Pat. Off. | 355/279 |

*Primary Examiner*—A. T. Grimley
*Assistant Examiner*—William J. Royer
*Attorney, Agent, or Firm*—H. Fleischer; J. E. Beck; R. Zibelli

[57] ABSTRACT

An apparatus for transferring a developed image from a surface to a heated intermediate member. The intermediate member is reheated to at least partially melt the image therein. Thereafter, the image is transferred from the intermediate member to a sheet and fixed thereto.

16 Claims, 2 Drawing Sheets

THERMAL TRANSFER APPARATUS

Figure 1:
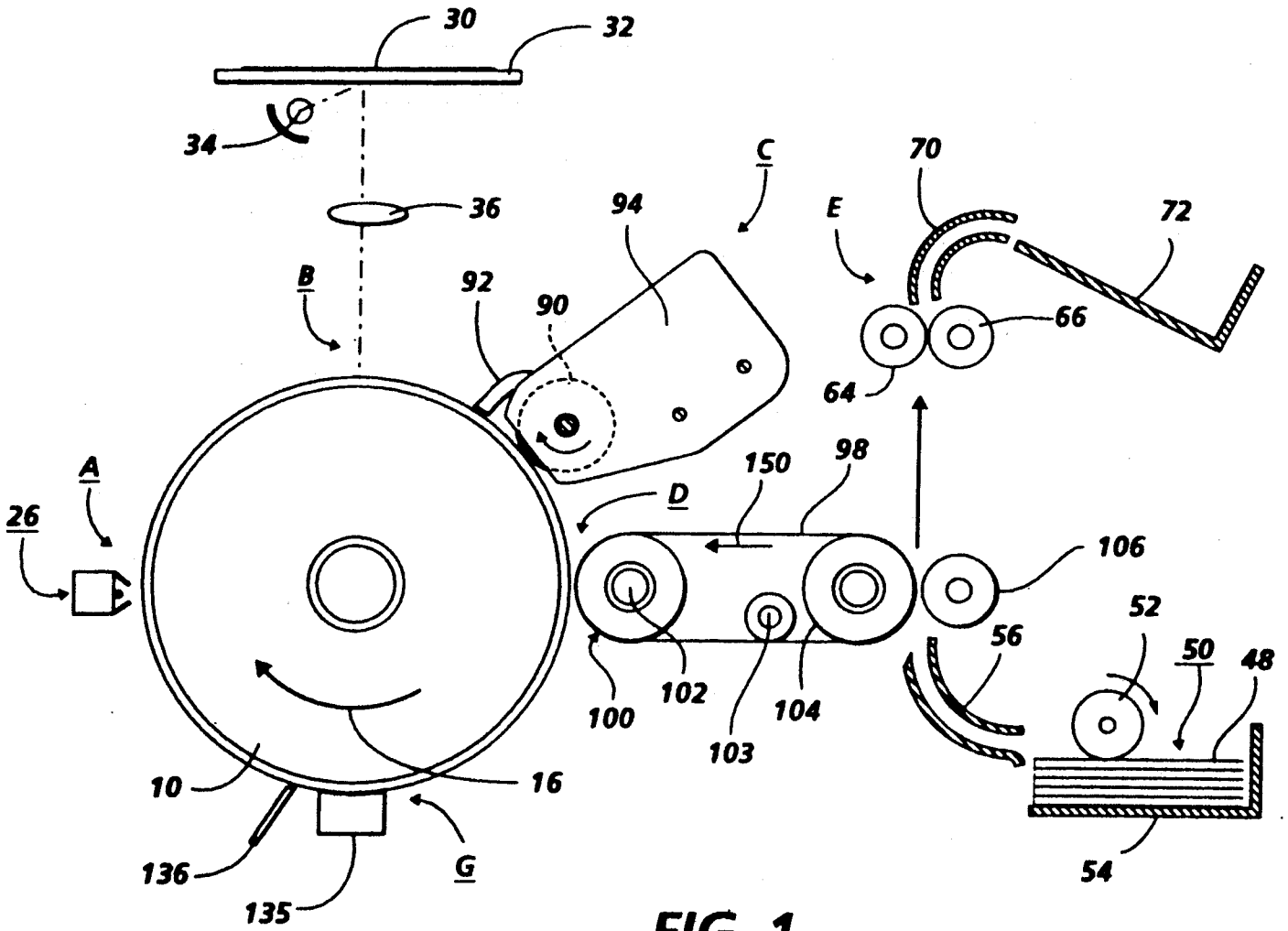

This invention relates generally to an electrophotographic printing machine, and more particularly concerns transferring a developed image from a photoconductive surface to an intermediate member before being transferred to a sheet of support material.

Generally, the process of electrophotographic printing includes charging a photoconductive member to a substantially uniform potential to sensitize the surface thereof. The charged portion of the photoconductive member is exposed to a light image of an original document being reproduced. This records an electrostatic latent image on the photoconductive member corresponding to the informational areas contained within the original document. After the electrostatic latent image is recorded on the photoconductive member, the latent image is developed by bringing a developer material into contact therewith. The developer material may be liquid or powder material. In the case of a liquid developer material, liquid developer is deposited, in image configuration, on the photoconductive member. Thereafter, the developed image is transferred to a sheet of support material. In the case of a liquid developer, the developed image includes residual liquid carrier and pigmented particles. After transfer, heat is applied to the sheet to permanently fuse the pigmented particles to the copy sheet and vaporize the residual liquid carrier adhering thereto.

Transfer of the liquid or powder image to the sheet is generally achieved by applying an electrostatic force, in the transfer zone, to overcome the forces holding the liquid or powder image to the photoconductive surface. On technique for generating electrostatic forces is by using a corona generating device for spraying ions onto the backside of the sheet. Another technique uses an electrically biased roller or belt engaging the backside of the copy sheet in the transfer zone. The liquid or powder image is not always completely transferred and smudging or smear of the liquid or powder image may result.

Various types of transfer systems have hereinbefore been used as illustrated by the following disclosures, which may be relevant to certain aspects of the present invention:

U.S. Pat. No. 3,862,848
Patentee: Marley
Issued: Jan. 28, 1975

U.S. Pat. No. 3,893,761
Patentee: Buchan et al.
Issued: Jul. 8, 1975

U.S. Pat. No. 3,957,367
Patentee: Goel
Issued: May 18, 1976

U.S. Pat. No. 4,341,455
Patentee: Fedder
Issued: Jul. 27, 1982

U.S. Pat. No. 4,682,880
Patentee: Fujii et al.
Issued: Jul. 28, 1987

The relevant portions of the foregoing patents may be briefly summarized as follows:

U.S. Pat. No. 3,862,848 (Marley), discloses an electrostatic method for the reproduction of printed matter in which an electrostatic latent image is developed by the attraction of electroscopic marking particles thereto. The marking particles are then transferred to a first receptor surface by the simultaneous application of contact and a directional electrostatic field of a polarity to urge the marking particles to the receptor surface. The image is then transferred from the first receptor surface to a second receptor surface by the simultaneous application of contact and a directional electrostatic field of opposite polarity to urge the marking particles to the second receptor surface.

U.S. Pat. No. 3,893,761 (Buchan et al.), discloses an apparatus for transferring non-fused toner images from a first support material, such as a photoconductive insulating surface, to a second support material, such as paper, and fusing the toner images to the second support material. Such an apparatus includes an intermediate transfer member having a smooth surface of low surface free energy below 40 dynes per centimeter and a hardness of from 3 to 70 durometer. The intermediate transfer member can be, for example, have a 0.1 to 10 mil layer of silicone rubber or a fluoroelastomer coated onto a polyimide support. The member can be formed into belt or drum configuration. Toner images are transferred from the first support material to the intermediate transfer member by pressure transfer. The toner image is then heated on the intermediate transfer member to at least its melting point temperature, with heating preferably being selective. After the toner is heated, the second support material is brought into pressure contact with the hot toner. The toner is transferred and fused to the second support material.

U.S. Pat. No. 3,957,367 (Goel), discloses a color electrostatographic printing machine in which successive single color powder images are transferred, in superimposed registration with one another, to an intermediary. The multi-layered powder image is fused on the intermediary and transferred therefrom to a sheet of support material, forming a copy of the original document.

U.S. Pat. No. 4,341,455 (Fedder), discloses an apparatus for transferring magnetic and conducting toner from a dielectric surface to plain paper by interposing a dielectric belt mechanism between the dielectric surface of an imaging drum and a plain paper substrate. The toner is first transferred to the dielectric belt and subsequently transferred to the plain paper at a fusing station. The dielectric belt is preferably made from a material such as Teflon® or polyethylene. The toner particles do not stick to the dielectric belt as they are fused at the fusing station.

U.S. Pat. No. 4,682,880 (Fujii et al.), discloses a process wherein an electrostatic latent image is formed on a rotatable latent image bearing member and is developed with a developer into a visualized image. The visualized image is transferred by pressure to a rotatable visualized image bearing member. The steps are repeated with different color developers to form on the same visualized image bearing member a multi-color image which corresponds to one final image to be recorded. The latent image bearing member and the visualized image bearing member form a nip therebetween through which a recording material is passed so that the multi-color image is transferred to the recording material.

In accordance with one aspect of the present invention, there is provided an apparatus for transferring a developed image from a surface to a sheet of support material including an intermediate member having a portion thereof contacting the surface. Means are provided for heating at least the portion of said intermediate member contacting the surface to tack the image to the intermediate member. Means are provided for transferring the image from the intermediate member to the sheet of support material, and substantially simultaneously fixing the image thereto. Means are provided for heating the intermediate member so as to at least partially melt the image on said intermediate member before the transferring and fixing means transfers the image from the intermediate member to the sheet of support material.

Pursuant to another aspect of the present invention, there is provided an electrophotographic printing machine of the type having an image developed on a photoconductive surface, wherein the improvement includes an intermediate member having a portion thereof contacting the surface. Means are provided for heating at least the portion of said intermediate member contacting the surface to tack the image to the intermediate member. Means are provided for transferring the image from the intermediate member to the sheet of support material, and substantially simultaneously fixing the image thereto. Means are provided for heating the intermediate member so as to at least partially melt the image on said intermediate member before the transferring and fixing means transfers the image from the intermediate member to the sheet of support material.

Figure 2:
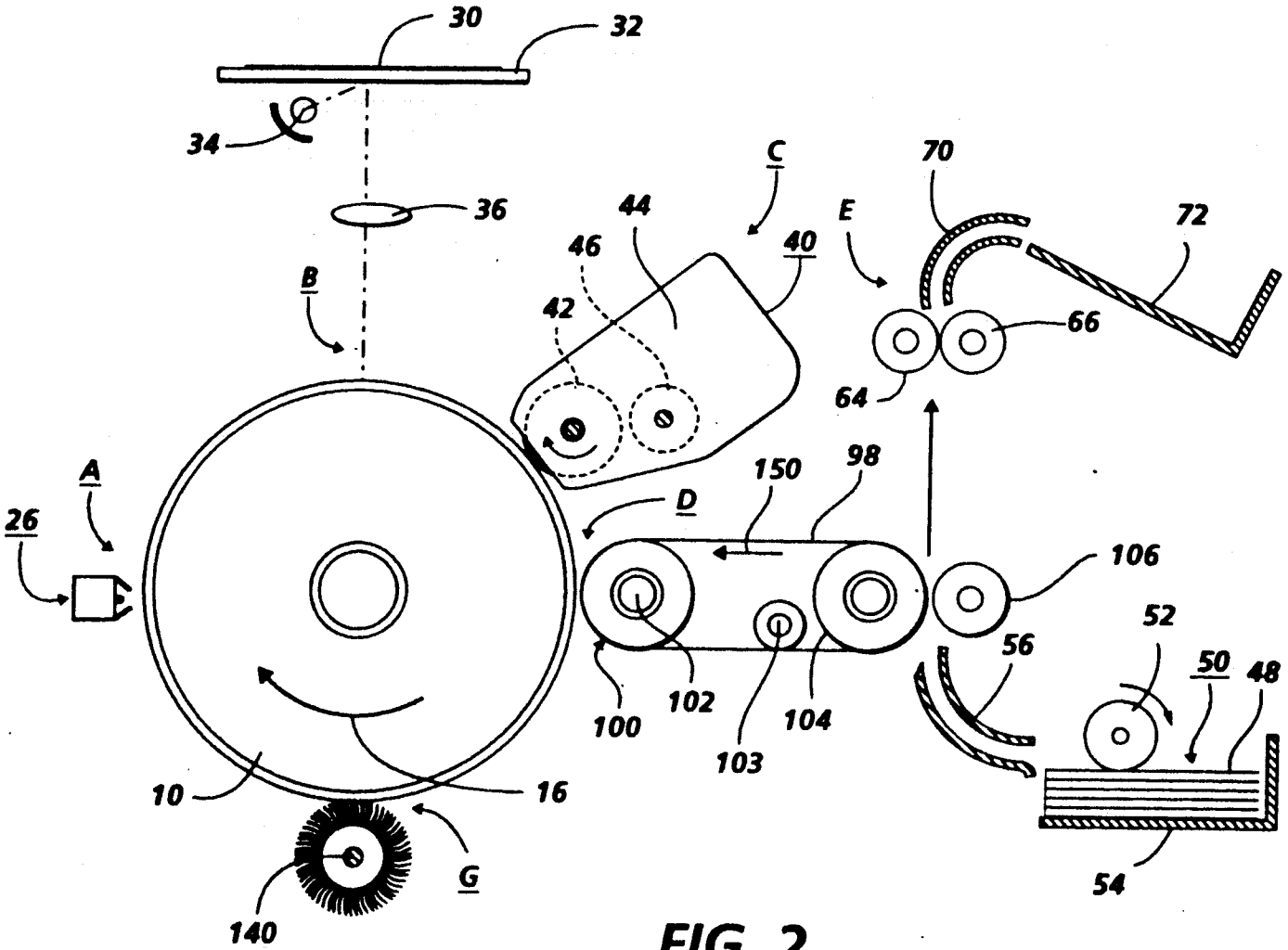

Other features of the present invention will become apparent as the following description precedes and upon reference to the drawings:

FIG. 1 is a schematic elevational view of an electrophotographic printing machine incorporating a liquid development system and the intermediate transfer belt of the present invention therein; and FIG. 2 shows a schematic elevational view of the electrophotographic printing machine incorporating a powder development system and the intermediate transfer belt of the present invention therein.

While the present invention will be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Inasmuch as the art of electrophotographic printing is well known, the various processing stations employed in the printing machine will be shown hereinafter schematically and their operation described briefly with reference thereto.

Referring initially to the FIG. 1, the electrophotographic printing machine employs a drum 10 having a photoconductive surface deposited on an electrically grounded conductive substrate. One skilled in the art will appreciate that any suitable photoconductive material may be used. Drum 10 moves in the direction of arrow 16 to advance successive portions of photoconductive surface sequentially through the various processing stations disposed about the path of movement thereof.

Initially, a portion of drum 10 passes through charging station A. At charging station A, a corona generating device, indicated generally by the reference numeral 26, charges the photoconductive surface of drum 10 to a relatively high, substantially uniform potential. A high voltage power supply is coupled to corona generating device 26. Excitation of the power supply causes corona generating device 26 to charge photoconductive surface of drum 10. After the photoconductive surface of drum 10 is charged, the charged portion thereof is advanced through exposure station B.

At exposure station B, an original document 30 is placed face down upon a transparent platen 32. Lamps 34 flash light rays onto original document 30. The light rays reflected from original document 30 are transmitted through lens 36 to form a light image thereof. Lens 36 focuses the light image onto the charged portion of the photoconductive surface to selectively dissipate the charge thereon. This records an electrostatic latent image on photoconductive surface which corresponds to the informational areas contained within original document 30. Alternatively, a raster output scanner may be used in lieu of the light lens system previously described to layout an image in a series of horizontal scan lines with each line having a specified number of pixels per inch. Typically, a raster output scanner includes a laser with a rotating polygon mirror block and a modulator.

After the electrostatic latent image has been recorded on photoconductive surface, drum 10 advances the latent image to development station C. At development station C, the developer system may employ liquid or powder material to produce a developed image. In the case of a liquid developer material, liquid developer comprising an insulating carrier liquid and toner particles, is circulated from sump 94 to pipe 92. Pipe 92 releases liquid developer onto the latent image, not shown. A development electrode, which may be appropriately electrically biased, assists in developing the electrostatic latent image with the toner particles, i.e. the pigmented particles dispersed in the liquid carrier, as it passes in contact with the developing liquid. The charged toner particles, disseminated throughout the carrier liquid, pass by electrophoresis to the electrostatic latent image. The charge of the toner particles is opposite in polarity to the charge on the photoconductive surface. By way of example, if the photoconductive surface is made from a selenium alloy, the photoconductive surface will be positively charged and the toner particles will be negatively charged. Alternatively, if the photoconductive surface is made from a cadmium sulfide material, the photoconductive surface will be negatively charged and the toner particles will be positively charged. Generally, an excessive amount of liquid carrier is deposited on the photoconductive surface. Roller 90 whose surface moves in a direction opposite to the direction of movement of the photoconductive surface, is spaced from the photoconductive surface and adapted to shear excessive liquid from the developed image without disturbing the image. Preferably, the developer material includes a liquid insulating carrier having pigmented particles, i.e. toner particles dispersed therein. A suitable insulating liquid carrier may be made from an aliphatic hydrocarbon, such as an Isopar, which is a trademark of the Exxon Corporation, having a low boiling point. The toner particles include a pigment, such as carbon black, associated with the polymer. A suitable liquid developer material is described in U.S. Pat. No. 4,582,774, issued to Landa in 1986, the relevant portions thereof being incorporated into the present application.

At the transfer station D, the liquid image is transferred onto an intermediate member such as a belt. The belt is made from a suitable flexible material such as Silicone rubber or Viton®. It should be evident that the intermediate member also could be a drum. Intermediate belt 98 is supported by three rollers 100, 103 and 104, and is in contact with drum 10. Roller 100 is rotatably driven by a suitable motor associated with a drive (not shown) to move belt 98 in the direction of arrow 150 at the same tangential velocity as drum 10. Rollers 100 and 103 have a heating element such as a infrared lamp positioned in the interior of rollers 100 and 103 the heat generated by heating element 102 is transferred to belt 98. When the liquid image enters the contact area between the drum 10 and belt 98, belt 98 is heated by heating element 102 to a temperature that causes the adhesion force to increases on belt 98 and the cohesion force between the particles of the liquid image to increase so that adhesion force on belt 98 and cohesion forces between the particles of the liquid image are both greater than the adhesion force holding the image onto drum 10. As a result, the liquid image on drum 10 is transferred to belt 98. It should be evident that one could employ electrostatic forces to assist transfer by electrical biasing the drum and/or belt. The transferred liquid image moves on belt 98 and is reheated by the heating element in roller 103 to a temperature in which the toner particles dispersed in liquid insulating carrier dissolve into the liquid carrier. Then, the liquid image is moved into in contact with a sheet of support material at fixing station E.

Fixing station E includes a quench roller 106 and roller 104, roller 104 is used as a back-up roller. A copy sheet 48 is advanced to fixing station E by sheet feeding apparatus 50. Preferably, sheet feeding apparatus 50 includes a feed roll 52 contacting the uppermost sheet of stack 54. Feed roll 52 rotates to advance the uppermost sheet from stack 54 into chute 56. Chute 56 directs the advancing sheet of support material into contact with the belt 98 in a timed sequence so that the liquid image thereon contacts the advancing sheet at fixing station E. Sheet 48 passes between roller 106 and roller 104 with the image contacting belt 98. Roller 106 is in contact with backside of sheet 48 and the liquid image is transferred from belt 98 to sheet 48 by pressure transfer. The pressure between belt 98 and roller 106 conforms the cooling liquid image into the paper fibers of sheet 48. The adhesion force of the cooling liquid image on sheet 48 is greater than the adhesion force of the liquid image on belt 98 resulting in the image being transferred to sheet 48. As the liquid image cools, it is permanently affixed to sheet 48. After fixing the image on sheet 48, rollers 64 and 66 advances sheet 48 through chute 70 to catch tray 72 for subsequent removal from the printing machine by the operator.

The residual liquid developer adhering to photoconductive surface are removed therefrom at cleaning station G. Cleaning station G includes a cleaning blade 136 and a foam sponge 135 in contact with the photoconductive surface of drum 10. The particles are cleaned from the photoconductive surface by the rotation of drum 10 in contact therewith. Subsequent to cleaning, a discharge lamp (not shown) floods photoconductive surface with light to dissipate any residual electrostatic charge remaining thereon prior to the charging thereof for the next successive imaging cycle.

FIG. 2 shows a schematic elevational view of the electrophotographic printing machine in FIG. 1 incorporating a powder development system. Charging station A and exposure station shown in the FIG. 2 printing machine are identical to the corresponding stations in the FIG. 1 printing. At development station C, preferably, developer unit 40 includes a magnetic roller 46, a donor roller 42 having a plurality of electrodes or electrical conductors (not shown) embedded therein and integral therewith. Donor roller 42 is mounted, at least partially, in the chamber of developer housing 44. The chamber in developer housing 44 stores a supply of developer material. The developer material is a two-component developer material of at least carrier granules having toner particles adhering triboelectrically thereto. Magnetic roller 46 disposed interiorly of the chamber of housing 44, conveys the developer material to donor roller 40. Electrical conductors are electrically biased in the development zone to detach toner from donor roll 42. In this way, a toner powder cloud is formed in the gap between donor roll 42 and photoconductive surface of drum 10. The latent image recorded on photoconductive surface attracts toner particles from the toner powder cloud forming a toner powder image thereon.

The developer material in the chamber of the developer housing is magnetic and may be electrically conductive. By way of example, the carrier granules include a ferro magnetic core having a thin layer of magnetite overcoated with a non-continuous layer of resinous material. The toner particles are made from a resinous material, such as a vinyl polymer mixed with a coloring material, such as chromogen black. The developer material comprises from about 95% to about 99% by weight of carrier and from 5% to about 1% by weight of toner. However, one skilled in the art will recognize that any other suitable developer material may be used.

At the transfer station D, the powder image is transferred onto intermediate belt 98. When the powder image enters the contact area between the drum 10 and belt 98, belt 98 is heated by heating element 102 to a temperature that causes the adhesion force to increases on belt 98 and the cohesion force between the particles of the powder image to increase so that adhesion force on belt 98 and cohesion forces between the particles of the powder image are both greater than the adhesion force holding the image onto drum 10. As a result, the powder image on drum 10 is transferred to belt 98. The transferred powder image moves on belt 98 and is reheated by the heating element in roller 103 to a temperature in which the toner particles melts on belt 98. Then, the powder image is moved into in contact with a sheet of support material at fixing station E.

At fixing station E, a copy sheet 48 is advanced to fixing station E by sheet feeding apparatus 50. Feed roll 52 rotates to advance the uppermost sheet from stack 54 into chute 56. Chute 56 directs the advancing sheet of support material into contact with the belt 98 in a timed sequence so that the melted powder image thereon contacts the advancing sheet at fixing station E. Sheet 48 passes between roller 106 and roller 104 with the image contacting belt 98. Roller 106 is in contact with backside of sheet 48 and the image is transferred from belt 98 to sheet 48 by pressure transfer. The pressure between belt 98 and roller 106 conforms the cooling powder image into the paper fibers of sheet 48. The adhesion force of the cooling powder image on sheet 48 is greater than the adhesion force of the powder image on belt 98 resulting in the image being transferred to sheet 48. As the powder image cools, it is permanently affixed to sheet 48. After fixing the image on sheet 48, roller 64 and 66 advances sheet 48 through chute 70 to catch tray 72 for subsequent removal from the printing machine by the operator.

The residual developer powder adhering to photoconductive surface are removed therefrom at cleaning station G. Cleaning station G includes a brush 140 in contact with the photoconductive surface of drum 10. The particles are cleaned from the photoconductive surface by the rotation of drum 10 in contact therewith. Subsequent to cleaning, a discharge lamp (not shown) floods photoconductive surface with light to dissipate any residual electrostatic charge remaining thereon prior to the charging thereof for the next successive imaging cycle.

In recapitulation, a developed image is transferred to a heated intermediate belt. The developed image is subsequently reheated prior to transfer and fusing to a sheet of support material.

It is, therefore, apparent that there has been provided in accordance with the present invention, a transfer apparatus that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. An apparatus for transferring a developed image from a surface to a sheet of support material, comprising:

an intermediate member having a portion thereof contacting the surface;

first means for heating at least the portion of said intermediate member contacting the surface to tack the image to said intermediate member;

means for transferring the image from said intermediate member to the sheet of support material, and substantially simultaneously fixing the image thereto; and second means, located intermediate and first heating means and said transferring and fixing means, for heating said intermediate member so as to at least partially melt the image tacked on said intermediate member before said transferring and fixing means transfers the image from said intermediate member to the sheet of support material.

2. An apparatus according to claim 1, wherein said intermediate member comprises a belt.

3. An apparatus according claim 2, wherein said first means comprises:

a roller defining a nip with the surface, said belt being entrained about a portion of said roller and passing through the nip; and means for heating said roller so as to heat at least the portion of said belt passing through the nip.

4. An apparatus according to claim 3, wherein said second means comprises a heated roller contacting said belt intermediate said first mentioned roller and said transferring and fixing means after transfer of the image to said belt.

5. An apparatus according to claim 4, wherein said transferring and fixing means comprises:

a second roller, spaced and opposed from said first mentioned roller, having a portion of said belt entrained thereabout; and means for pressing the sheet of support material into contact with the portion of said belt entrained about said second roller to transfer and fix the image to the sheet of support material.

6. An apparatus according to claim 1, wherein the developed image comprises a liquid image having pigmented particles dispersed in an insulating carrier.

7. An apparatus according to claim 6, wherein said second means heats said intermediate member to substantially dissolve the pigmented particles.

8. An apparatus according to claim 1, wherein the developed image comprises toner particles.

9. An electrophotographic printing machine of the type having an image developed on a photoconductive surface, wherein the improvement comprises:

an intermediate member having a portion thereof contacting the surface;

first means for heating at least the portion of said intermediate member contacting the surface to tack the image to said intermediate member;

means for transferring the image from said intermediate member to a sheet of support material, and substantially simultaneously fixing the image thereto; and second means, intermediate said first means and said transferring and fixing means, for heating said intermediate member so as to at least partially melt the image tacked on said intermediate member before said transferring and fixing means transfers the image from said intermediate member to the sheet of support material.

10. A printing machine according to claim 9, wherein said intermediate member comprises a belt.

11. A printing machine according to claim 10, wherein said first means comprises:

a roller defining a nip with the surface, said belt being entrained about a portion of said roller and passing through the nip; and means for heating said roller so as to heat at least the portion of said belt passing through the nip.

12. A printing machine according to claim 11, wherein said second means comprises a heated roller contacting said belt intermediate said first mentioned roller and said transferring and fixing means after transfer of the image to said belt.

13. A printing machine according to claim 12, wherein said transferring and fixing means comprises:

a second roller, spaced and opposed from said first mentioned roller, having a portion of said belt entrained thereabout; and means for pressing the sheet of support material into contact with the portion of said belt entrained about said second roller to transfer and fix the image to the sheet of support material.

14. A printing machine according to claim 9, wherein the developed image comprises a liquid image having pigmented particles dispersed in an insulating carrier.

15. A printing machine according to claim 13, wherein said second means heats said intermediate member to substantially dissolve the pigmented particles.

16. A printing machine according to claim 9, wherein the developed image comprises toner particles.

* * * * *

UNITED STATES PATENT AND TRADEMARK OFFICE

CERTIFICATE OF CORRECTION

PATENT NO. : 5,233,397

DATED : August 3, 1993

INVENTOR(S) : Henry R. Till

It is certified that error appears in the above--identified patent and that said Letters Patent is hereby corrected as shown below:

Col. 7, Line 45, change "and" to - -said- -.

Signed and Sealed this

Twelfth Day of April, 1994

Bruce Lehman

*Attest:*

BRUCE LEHMAN

*Commissioner of Patents and Trademarks*

*Attesting Officer*